US007073728B2

(12) United States Patent
Watson et al.

(10) Patent No.: US 7,073,728 B2
(45) Date of Patent: Jul. 11, 2006

(54) WATER FEATURE AND WRITING BOARD

(75) Inventors: Arthur D. Watson, Parker, CO (US); Gary R. Kiepke, Littleton, CO (US)

(73) Assignee: Kloppenberg & Company, Englewood, CO (US)

( * ) Notice: Subject to any disclaimer, the term of this patent is extended or adjusted under 35 U.S.C. 154(b) by 21 days.

(21) Appl. No.: 10/848,320

(22) Filed: May 18, 2004

(65) Prior Publication Data

US 2005/0258268 A1 Nov. 24, 2005

(51) Int. Cl.

| | |
|---|---|
| ***F21S 8/00*** | (2006.01) |
| ***B05B 17/08*** | (2006.01) |
| ***B05B 15/00*** | (2006.01) |
| ***B05B 17/00*** | (2006.01) |
| ***B05B 1/36*** | (2006.01) |

(52) U.S. Cl. ..... 239/20; 239/17; 239/18; 239/22; 239/289; 239/193; 312/139.1; 312/322; 40/406

(58) Field of Classification Search ..... 239/20, 239/17, 18, 22, 289, 193, 16, 21, 23; 312/139.1, 312/322, 230, 237, 283, 349; 362/96; 40/406, 40/409; 119/253, 255–257, 265, 266
See application file for complete search history.

(56) References Cited

U.S. PATENT DOCUMENTS

| | | | | |
|---|---|---|---|---|
| 2,531,002 | A * | 11/1950 | Sisk et al. | 40/406 |
| 3,211,378 | A | 10/1965 | Zysk | |
| 3,386,197 | A * | 6/1968 | Elfstrom | 40/572 |
| 3,644,726 | A | 2/1972 | Pfeuffer | |
| 4,299,043 | A * | 11/1981 | Lathrop et al. | 40/624 |
| 4,352,149 | A | 9/1982 | Stetler | |
| 4,747,538 | A | 5/1988 | Dunn et al. | |
| 5,167,368 | A | 12/1992 | Nash | |
| 5,226,935 | A | 7/1993 | Wolff et al. | |
| 5,291,674 | A * | 3/1994 | Torrence | 40/410 |
| 5,794,318 | A * | 8/1998 | Parker et al. | 27/1 |
| 6,024,292 | A * | 2/2000 | Wilson | 237/78 R |
| 6,176,027 | B1 | 1/2001 | Blount | |
| 6,187,394 | B1 | 2/2001 | Johnson et al. | |
| 6,279,835 | B1 | 8/2001 | Hansen | |
| 6,311,898 | B1 | 11/2001 | Gruff | |
| 6,499,263 | B1 | 12/2002 | Johnson | |
| D470,215 | S | 2/2003 | Lussier | |
| 6,695,221 | B1 | 2/2004 | Lussier | |

* cited by examiner

*Primary Examiner*—David A. Scherbel
*Assistant Examiner*—Darren Gorman
(74) *Attorney, Agent, or Firm*—Dorr, Carson & Birney, P.C.

(57) ABSTRACT

A combination water feature and writing board has a front displaying a flow of water, and a number of movable writing board segments. These segments can be moved between a stored position in which the segments are stored behind the water feature, and an deployed position in which the segments cover the front of the water feature to provide a writing surface.

13 Claims, 9 Drawing Sheets

WATER FEATURE AND WRITING BOARD

BACKGROUND OF THE INVENTION

1. Field of the Invention

The present invention relates generally to the fields of water features and writing boards. More specifically, the present invention discloses a water feature with a writing board that can either be stored behind the water feature or deployed for use in front of the water feature.

2. Statement of the Problem

Water features have been used for many years as decorative or artistic objects. For example, some types of water features are intended to simulate waterfalls or bubbling fountains. One type of water feature has a vertical surface of some type (e.g., a flat or corrugated surface) displaying a curtail-like flow of water to provide a pleasing visual effect, a reservoir to hold water draining from the vertical surface, and a recirculating pump. The following are examples of water features found in the prior art:

| Inventor | Patent No. | Issue Date |
|---|---|---|
| Zysk | 3,211,378 | Oct. 12, 1965 |
| Pfeuffer | 3,644,726 | Feb. 22, 1972 |
| Stetler | 4,352,149 | Sep. 28, 1982 |
| Dunn et al. | 4,747,538 | May 31, 1988 |
| Nash | 5,167,368 | Dec. 1, 1992 |
| Wolff et al. | 5,226,935 | Jul. 13, 1993 |
| Blount | 6,176,027 | Jan. 23, 2001 |
| Johnson et al. | 6,187,394 | Feb. 13, 2001 |
| Hansen | 6,279,835 | Aug. 28, 2001 |
| Gruff | 6,311,898 | Nov. 6, 2001 |
| Johnson | 6,499,263 | Dec. 31, 2002 |
| Lussier | D470,215 | Feb. 11, 2003 |
| Lussier | 6,695,221 | Feb. 24, 2004 |

Blackboards, white boards, and other types of writing boards have also been widely used for many years. These writing boards are typically made in one or more panels. Some writing boards, such as blackboards used in large university lecture halls, include panels that can slide upward or laterally to reveal a second panel beneath, and thereby increase the writing area available to the lecturer.

The use of writing boards in conference rooms or board rooms in business or government poses additional concerns. Writing boards are often given a prominent location in a conference room (e.g., at the head of the conference table) so that the writing board will be readily visible to all participants when board is being used. However, a conventional white board or blackboard board is not really very aesthetically pleasing, in and of itself. Yet, the writing board remains prominently visible even when not in use.

A second, related concern is the privacy or confidentiality of things that have been written on a writing board in a conference room, particularly if the same conference room is used by different groups of people over time. It can be difficult to completely erase a blackboard or white board so that previously written items are no longer legible. Therefore, a need exists for a writing board that can be concealed or stored when not in use.

Solution to the Problem.

Nothing in the prior art teaches or suggests a combined water feature and writing board. In particular, nothing in the prior art teaches or suggests a writing board that can be concealed and stored behind a water feature when not in use.

The water feature provides a pleasing aesthetic appearance and conceals any writing displayed on the writing board.

SUMMARY OF THE INVENTION

This invention provides a combination water feature and writing board. The water feature has a front vertical surface displaying a flow of water, a reservoir to hold water draining from the front vertical surface, and a pump recirculating water from the reservoir to the vertical surface. The writing board has a number of segments that can be moved between a stored position in which the writing board segments are stored behind the front vertical surface of the water feature, and an deployed position in which the segments cover the front vertical surface of the water feature to provide a writing surface.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
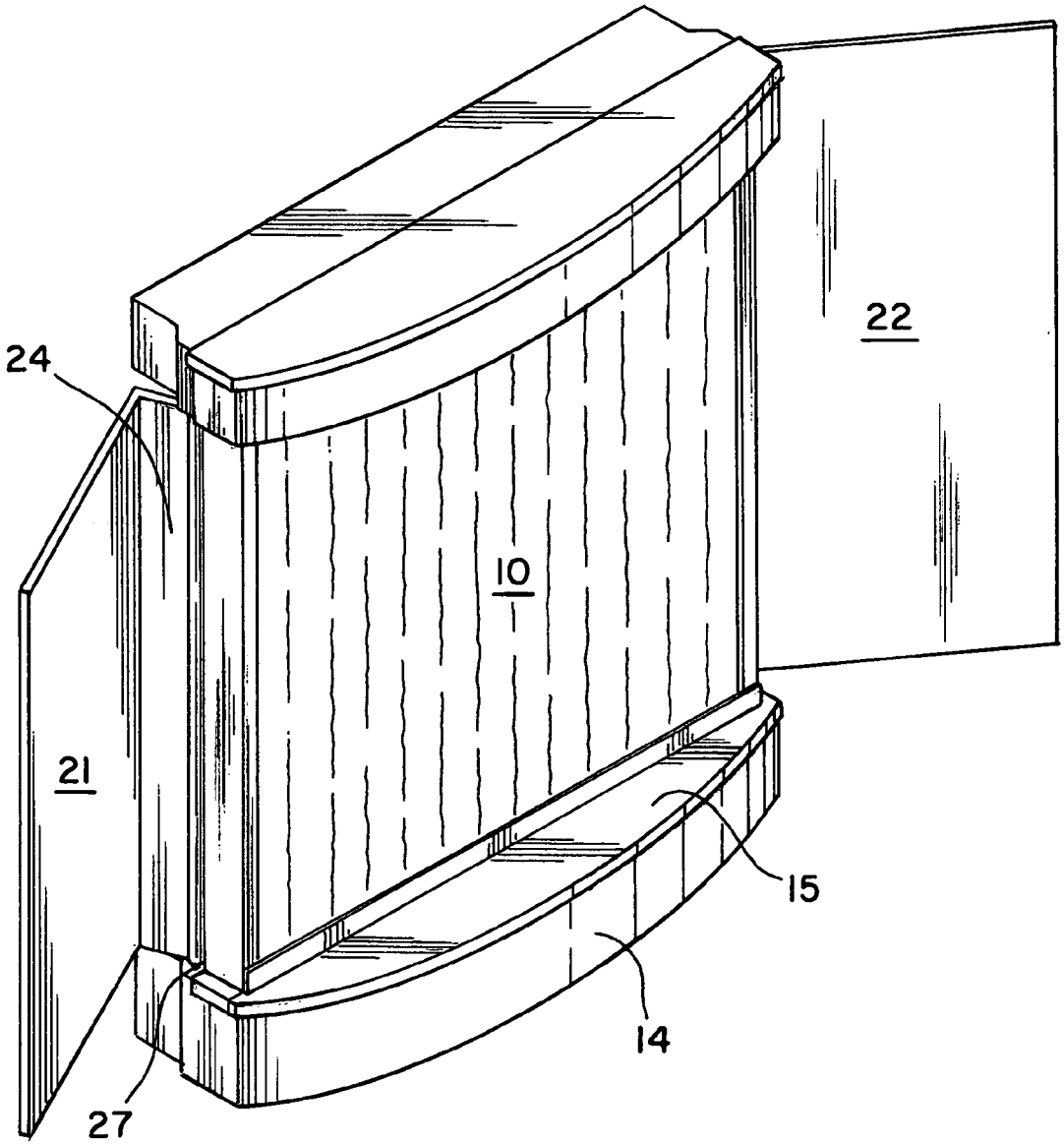
FIG. 1 is a front perspective view of the present invention with the segments of the writing board 21, 22 partially open.
Figure 5:
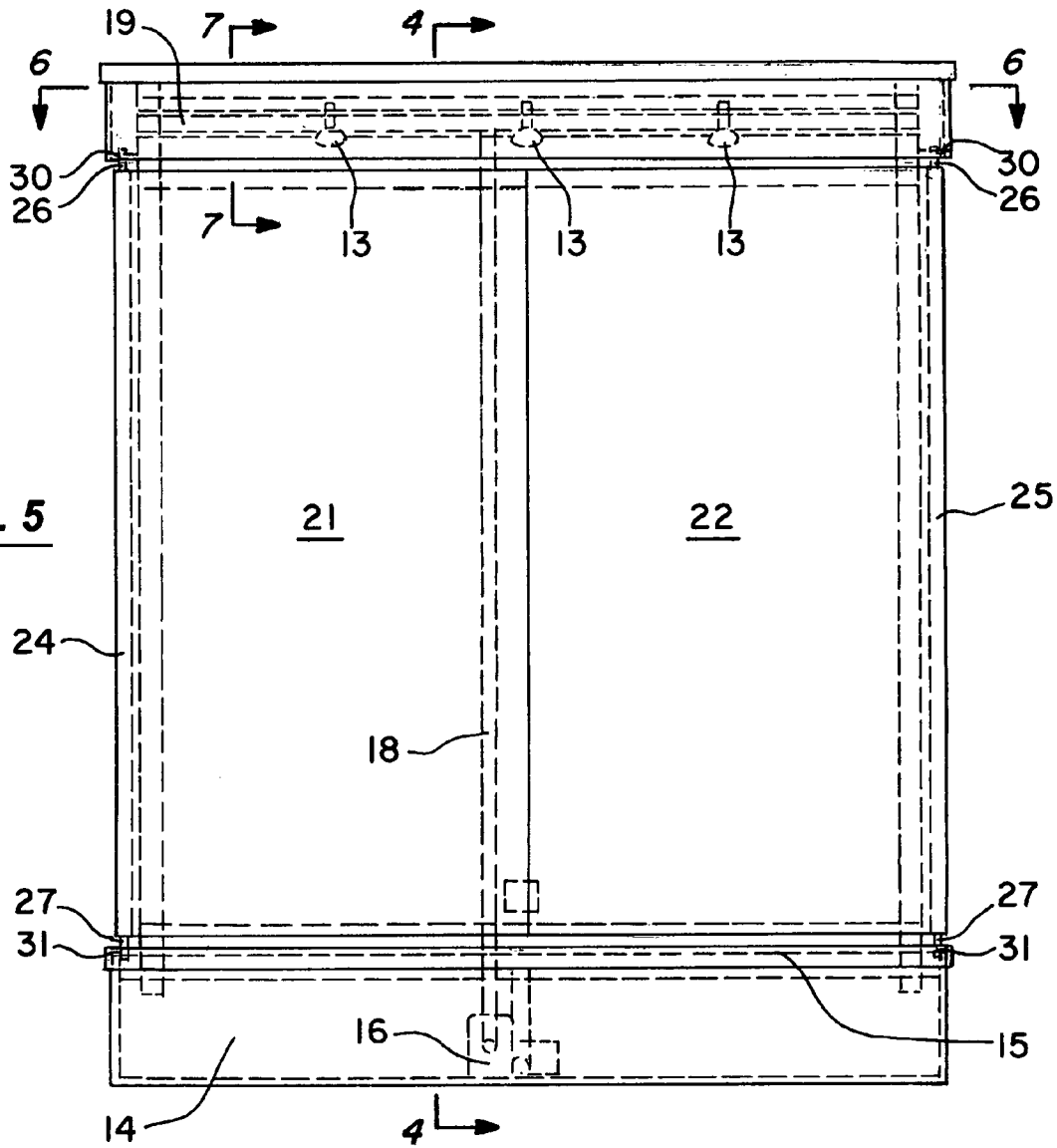
FIG. 5 is a front elevational view of the present invention.
Figure 4:
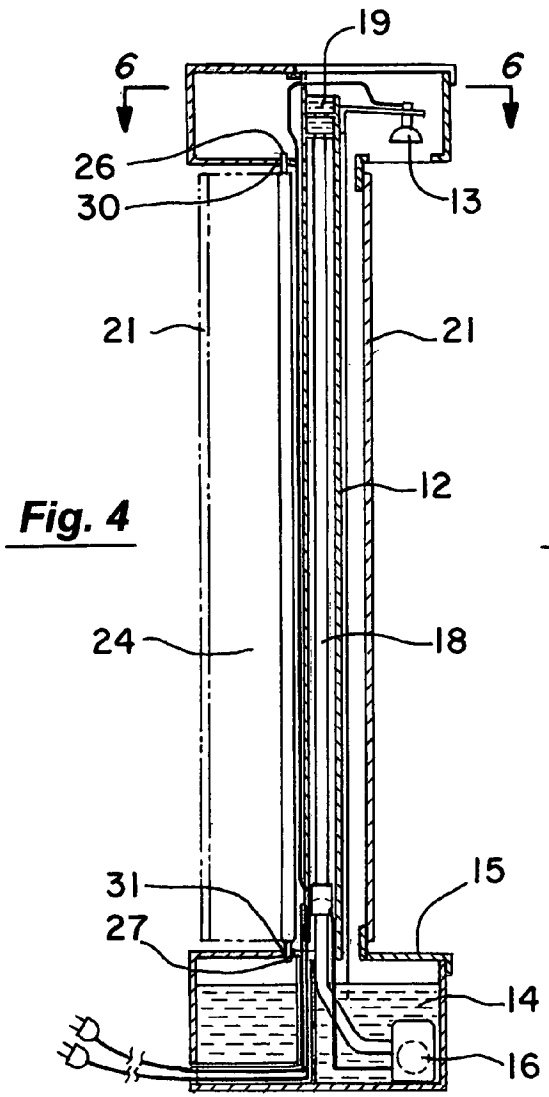
FIG. 4 is a vertical cross-sectional view of the present invention.
Figure 7:
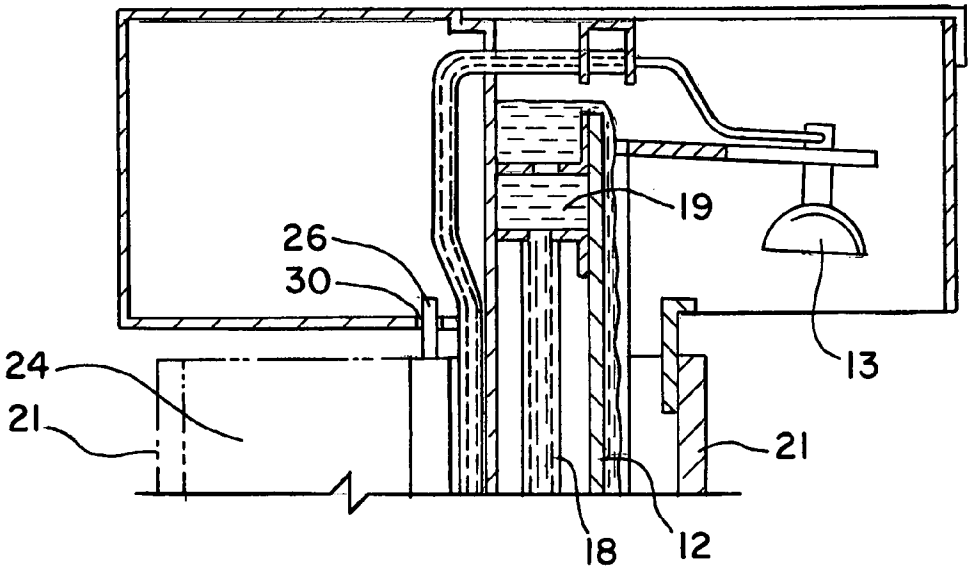
FIG. 7 is a detail vertical cross-sectional view of the upper portion of the present invention.
Figure 6:
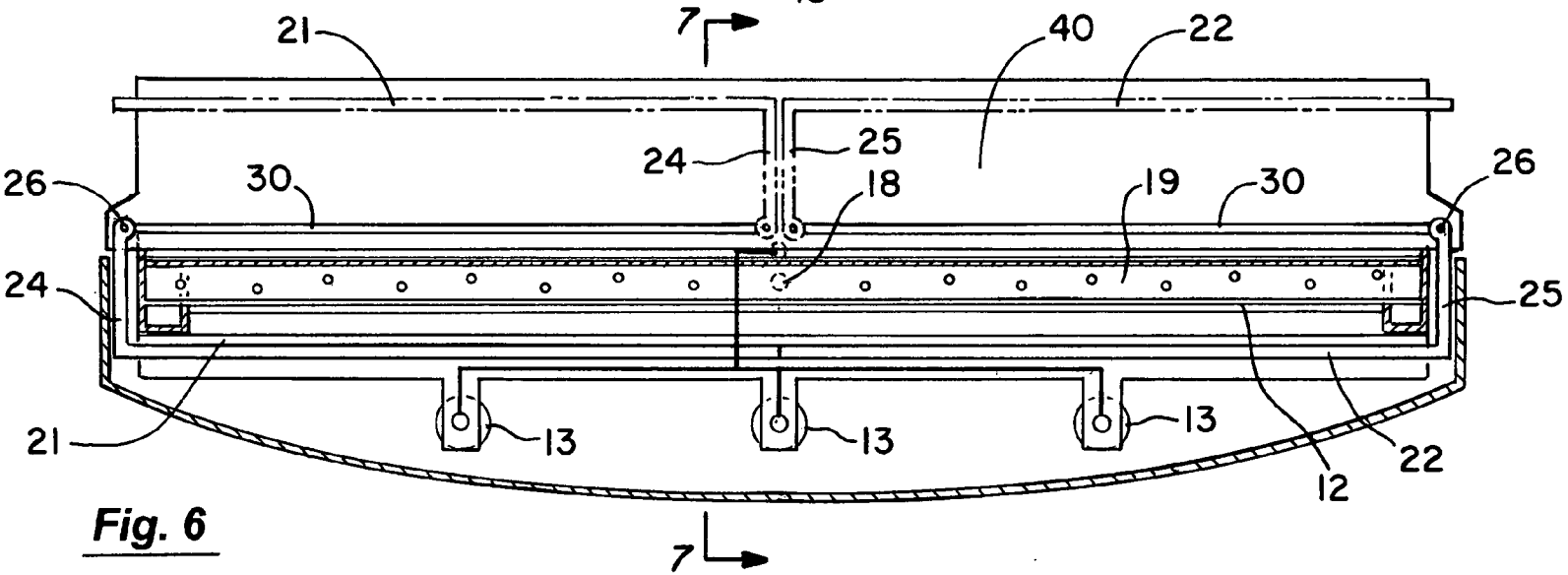
FIG. 6 is a cross-sectional view taken along a horizontal plane extending through the upper portion of the present invention.

Turning to FIG. 1, a front perspective view is provided showing an embodiment of the present invention. The water feature 10 typically includes a front surface 12 that is generally vertical in orientation, so that water can flow down the front surface 12 into a reservoir 14 at the bottom of the water feature 10. For example, the front surface 12 can be smooth, corrugated, textured, or otherwise shaped to produce a pleasing aesthetic appearance. As shown in FIGS. 4, 5 and 7, water is recirculated from the reservoir 14 by means of a pump 16 through tubing 18 leading to a horizontal trough 19 extending across the top of the front surface 12 of the water feature 10. The trough 19 is shown most clearly in the horizontal cross-sectional view illustrated in FIG. 6. A removable lid 15 covers the front portion of the reservoir 14 and provides access for servicing the pump 16, and for draining and cleaning the reservoir 14.

The writing board is composed of a number of movable segments 21, 22. Each segment of writing board has a front surface suitable for displaying writing. For example, writing board could be a white board suitable for being written on with a felt markers. Alternatively, the writing board could be a black board suitable for being written on with chalk. Other types of conventional writing surfaces could be readily substituted.

Figure 3:
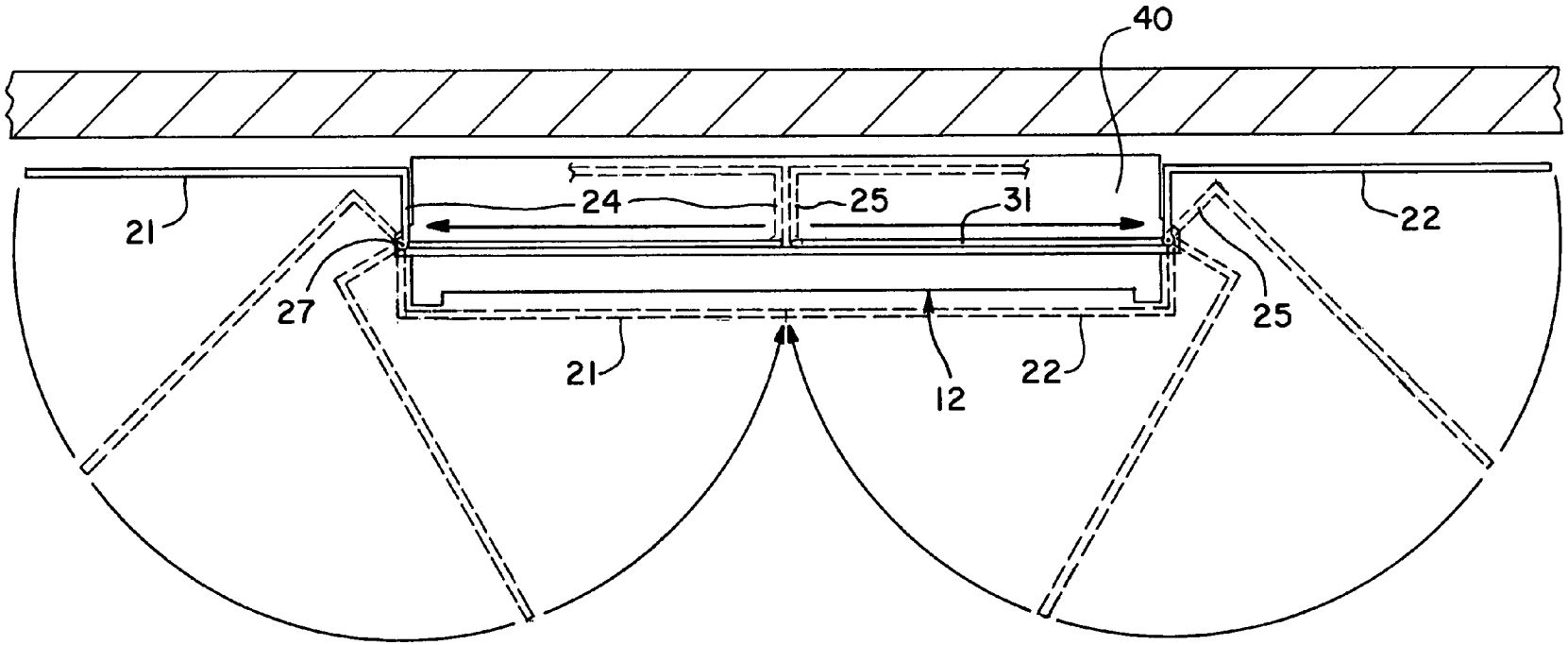
FIG. 3 is a top view of the present invention illustrating the swinging motion of the writing board segments 21, 22.

The segments 21, 22 of writing board can be moved between a stored position in which the segments 21, 22 are stored behind the water feature 10, and an deployed position in which the segments 21, 22 combine to cover the front of the water feature and thereby provide a writing surface, as illustrated in FIG. 3. In this embodiment, the writing board consists of two segments 21, 22 that can be pulled laterally outward from the right and left sides of the water feature 10, respectively. However, it should be understood that the number, orientations and positions of the writing board segments are largely a matter of design choice. A number of lights 13 can be mounted to the top of the device to illuminate the water feature and/or writing surface.

The embodiment shown in FIGS. 1–7, writing board segment 21, 22 includes a pair of pins 26, 27 that engage corresponding upper and lower tracks 30 and 31 in the storage area 40 behind the water feature. These pins 26, 27 extend vertically from the top and bottom edges of each writing board segment 21, 22 and allow the writing board segments 21, 22 to slide freely along the rear tracks 30 and 31.

Figure 2:
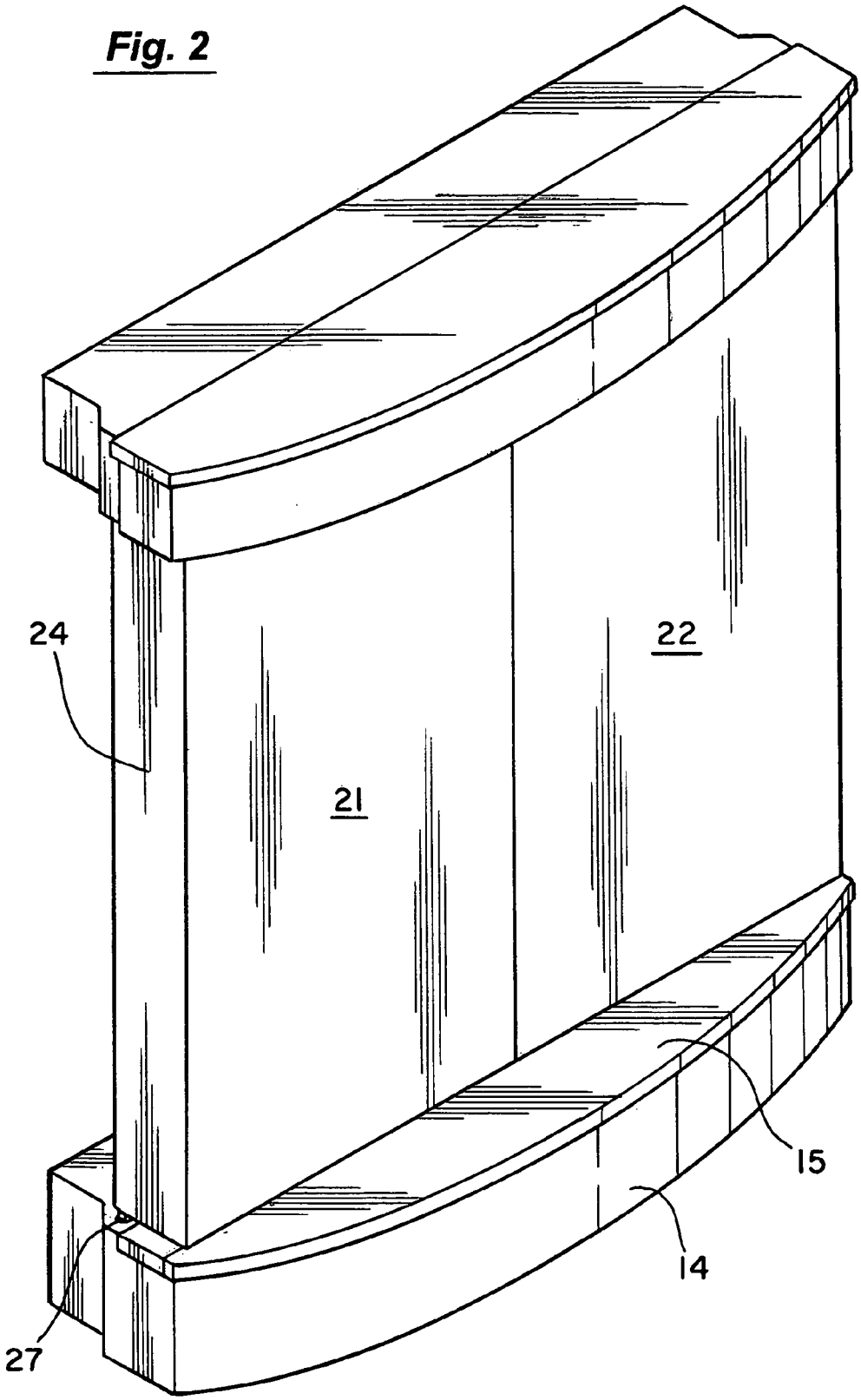
FIG. 2 is a front perspective view with the writing board segments 21, 22 in the deployed position to cover the front of the water feature.

When the writing broad segments 21, 22 are being deployed, the pins 26, 27 slide laterally outward along the rear tracks 30 and 31, thereby enabling the user to pull the writing board segments 21, 22 laterally outward from the storage area 40. At this point, the writing board segments 21, 22 can be rotated forward about vertical axis of the pins 26, 27 as shown in FIGS. 1 and 3, to cover the front of the water feature 10, as shown in FIG. 2. Optionally, magnets or other fasteners can be used to removably attach the writing board panels 21, 22 to the front of the water feature 10 in the deployed position.

This process is reversed to move the writing board segments 21, 22 to the stored position when the writing board is not in use. The writing board segments are rotated backward about the vertical axis of the pins 26, 27 until they are roughly in lateral alignment with the storage area 40. The user then pushes the writing board segments 21, 22 laterally inward into the storage area 40. The pins 26, 27 slide along the rear tracks 30 and 31 as the writing board segments move into the storage area 40 behind the water feature. Thus, the writing board segments 21, 22 are not normally visible from the front of the assembly while they are in the stored position behind the water feature.

It should be expressly understood that other types of sliding mechanism could be readily substituted for the pins 26, 27 and rear tracks 30, 31. For example, other types of pin/track mechanisms, roller mechanisms, brackets, or linkages could be substituted to enable the writing board segments 21, 22 to be moved between a stored position behind the water feature 10 and a deployed position in front of the water feature 10.

It should be noted that each writing board segment 21, 22 can be provided with an edging 24, 25 that results in an L-shaped writing board segment, as shown in FIGS. 1 and 3. The edgings 24, 25 accommodate the thickness of the water feature and allow the writing board segments 21, 22 to form a flat writing surface. Alternatively, L-shaped mounting brackets could be attached to the edges of the writing board segments 21, 22 for this purpose.

Figure 8:
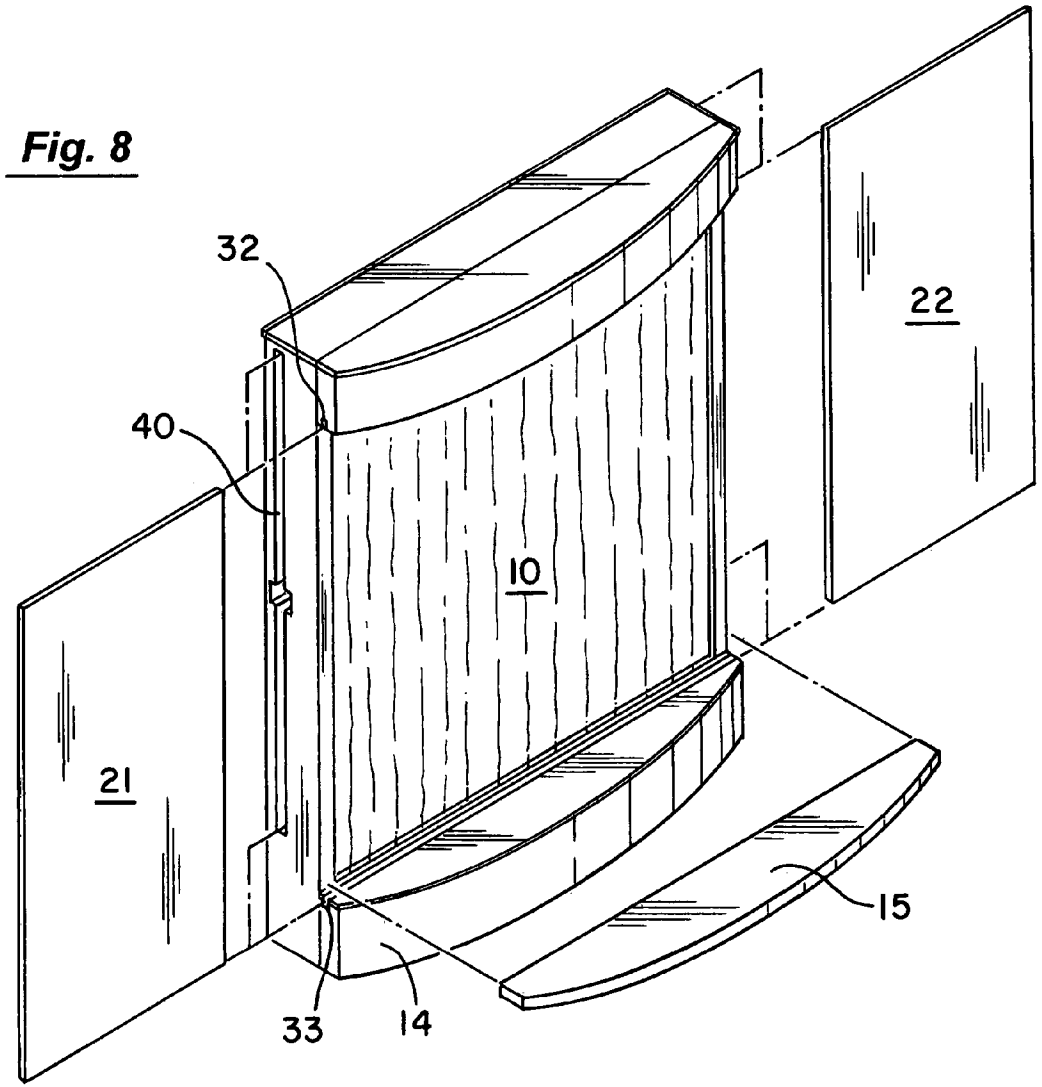
FIG. 8 is a front perspective view of another embodiment of the present invention with writing board segments 21, 22 that slide into tracks 32, 33 to cover the water feature 10.
Figure 9:
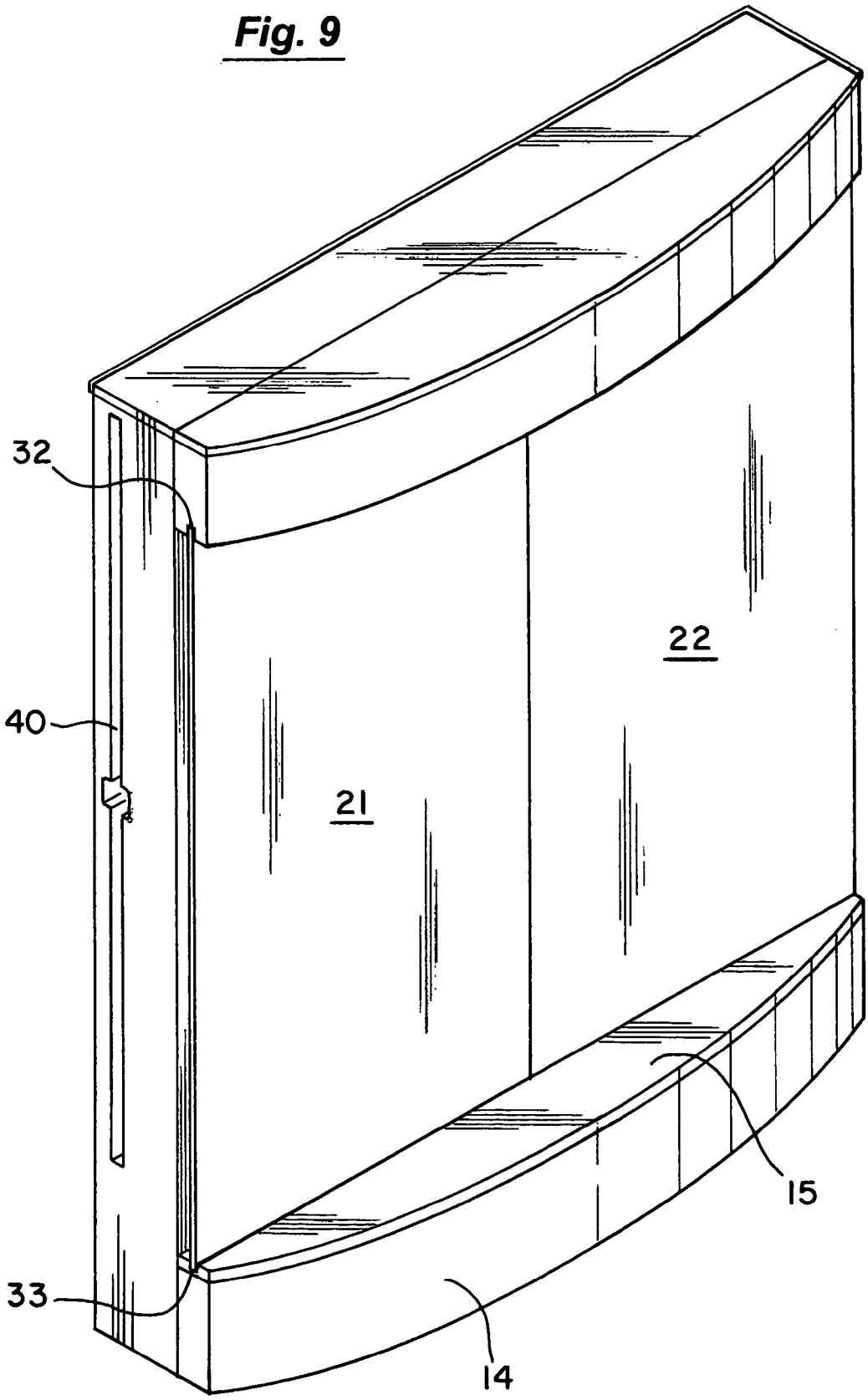
FIG. 9 is a front perspective view corresponding to the FIG. 8 with the writing board segments 21, 22 inserted to cover the water feature.
Figure 11:
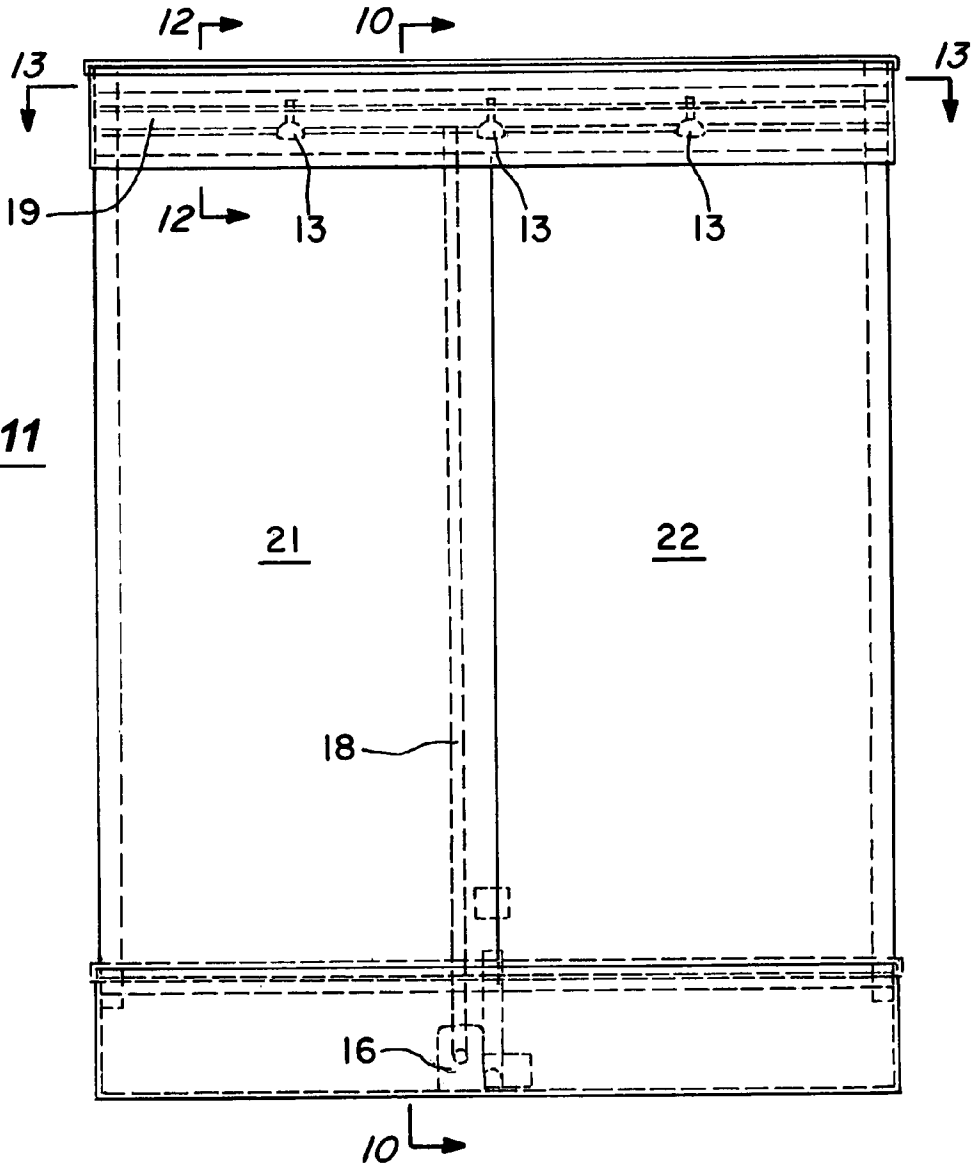
FIG. 11 is a front elevational view of the embodiment shown in FIGS. 8 and 9
Figure 10:
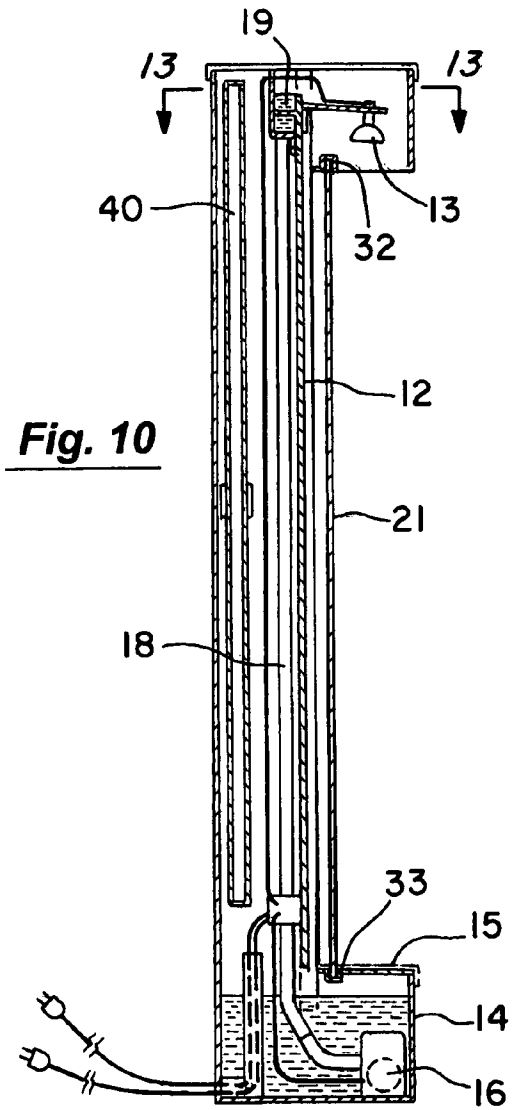
FIG. 10 is a vertical cross-sectional view of the embodiment shown in FIG. 8.
Figure 12:
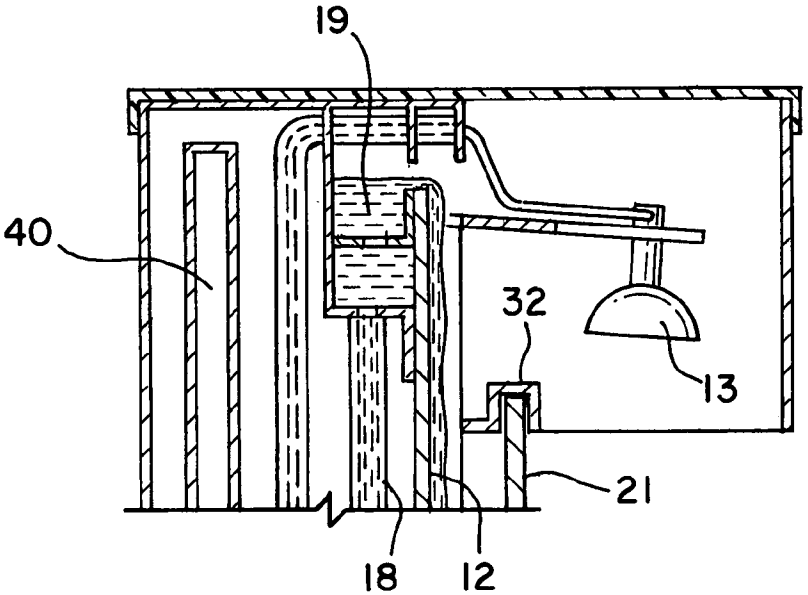
FIG. 12 is a detail vertical cross-sectional view of the upper portion of the embodiment shown in FIGS. 8 and 9.
Figure 13:
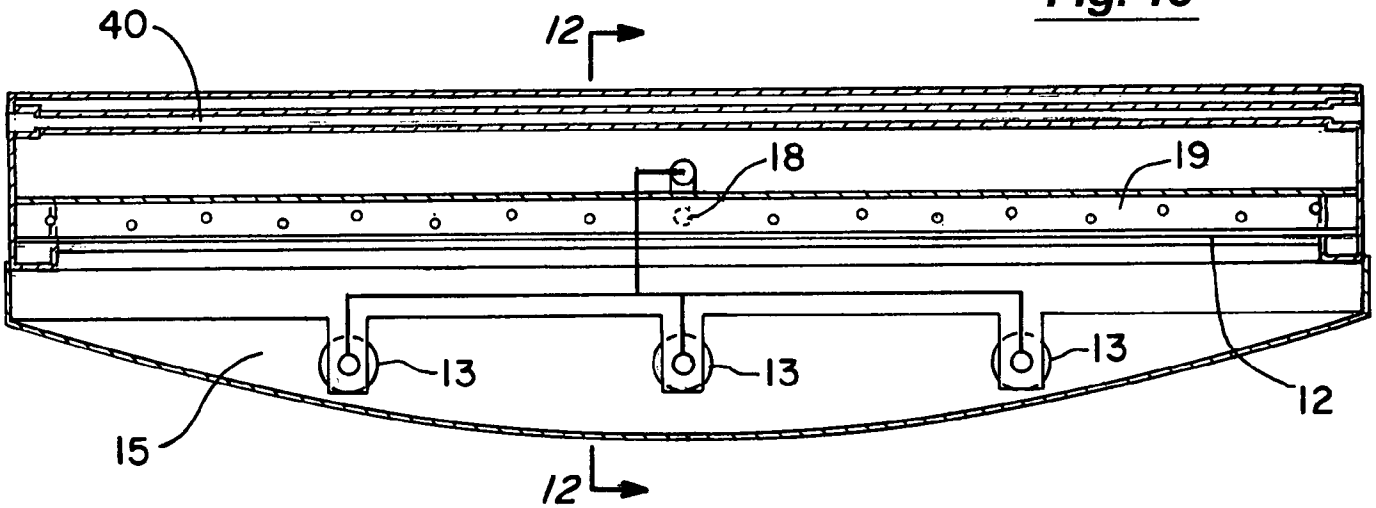
FIG. 13 is a cross-sectional view taken along a horizontal plane extending through the upper portion of the embodiment shown in FIGS. 8 and 9.

Another embodiment of the present invention is shown in FIGS. 8–13, which eliminates the pins 26, 27 from the previous embodiment. As illustrated in FIG. 8, the user manually slides the writing board segments 21, 22 into the front tracks 32, 33 to cover the water feature 10, as shown in FIG. 9. FIG. 10 is a corresponding vertical cross-sectional view and FIG. 11 provides a front elevational view of this embodiment.

The user can also slide the writing board segments 21, 22 into the side openings of the storage area 40 behind the water feature 10. This embodiment offers the advantage of requiring only a very narrow storage area 40, which reduces the thickness of the overall assembly, as shown in the cross-sectional views of this embodiment provided in FIGS. 12 and 13.

Here again, the writing board can be made of one or more segments. The tracks can be oriented horizontally for lateral insertion of the writing board segments 21, 22, or vertically for vertical insertion of the writing board segments 21, 22. This embodiment has the advantage of allowing the use of multiple sets of writing board segments that can be displayed and stored selectively to provide multiple writing surfaces. In addition, motors can be used to automate movement of the writing board segments 21, 22 between their stored and deployed positions.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. An apparatus comprising:

a water feature having a front and at least one track on the rear of the water feature; and a writing board having at least one segment with a surface for displaying writing, being movable between a stored position in which the at least one segment of the writing board is stored behind the water feature in sliding engagement with the at least one track, and a deployed position in which the at least one segment of the writing board covers the front of the water feature to provide a writing surface.

2. The apparatus of claim 1 wherein the writing board comprises at least two segments that can be withdrawn laterally outward from opposing sides of the water feature when moving from the stored position to the deployed position.

3. The apparatus of claim 1 wherein the front of the water feature displays a flow of water.

4. The apparatus of claim 1 wherein the water feature further comprises at least one track in the front of the water feature for sliding engagement with at least one segment of the writing board in the deployed position.

5. The apparatus of claim 1 wherein the water feature further comprises at least one storage area behind the front of the water feature to hold at least one segment of the writing board in the stored position.

6. An apparatus comprising:

a water feature having:

(a) a front vertical surface displaying a flow of water;

(b) a reservoir to hold water draining from the front vertical surface;

(c) a pump recirculating water from the reservoir to the front vertical surface; and (d) at least one track on the rear of the water feature; and a writing board having at least one segment with a surface for displaying writing, being movable between a stored position in which the at least one segment of the writing board is stored behind the front vertical surface of the water feature in sliding engagement with the at least one track, and a deployed position in which the at least one segment of the writing board covers the front vertical surface of the water feature to provide a writing surface.

7. The apparatus of claim 6 wherein the at least one segment of the writing board can be withdrawn laterally outward from opposing sides of the water feature when moving from the stored position to the deployed position.

8. The apparatus of claim 6 wherein the water feature further comprises at least one track in the front of the water feature for sliding engagement with at least one segment of the writing board in the deployed position.

9. The apparatus of claim 6 wherein the water feature further comprises at least one storage area behind the front vertical surface of the water feature to hold at least one segment of the writing board in the stored position.

10. An apparatus comprising:

a water feature having a front displaying a flow of water and at least one track on the rear of the water feature; and a writing board having a plurality of segments movable between a stored position in which the segments of the writing board are laterally inserted in sliding engagement with the at least one track behind the water feature for storage, and a deployed position in which the segments of the writing board are withdrawn laterally outward from behind the water feature to provide a writing surface covering the front of the water feature.

11. The apparatus of claim 10 wherein the water feature further comprises at least one track in the front of the water feature for sliding engagement with segments of the writing board in the deployed position.

12. The apparatus of claim 10 wherein the water feature further comprises at least one storage area behind the front of the water feature to hold the segments of the writing board in the stored position.

13. The apparatus of claim 10 wherein the water feature further comprises:

a front vertical surface displaying a flow of water;

a reservoir to hold water draining from the front vertical surface; and a pump recirculating water from the reservoir to the front vertical surface.

* * * * *